US008618451B2

(12) United States Patent
Kunisada

(10) Patent No.: US 8,618,451 B2
(45) Date of Patent: Dec. 31, 2013

(54) HEATER MEMBER FOR CHAIR AND METHOD FOR PRODUCING THE SAME

(75) Inventor: Hideaki Kunisada, Komaki (JP)

(73) Assignee: Toyota Boshoku Kabushiki Kaisha, Aichi-Ken (JP)

( * ) Notice: Subject to any disclaimer, the term of this patent is extended or adjusted under 35 U.S.C. 154(b) by 126 days.

(21) Appl. No.: 13/151,764

(22) Filed: Jun. 2, 2011

(65) Prior Publication Data

US 2011/0297667 A1 Dec. 8, 2011

(30) Foreign Application Priority Data

Jun. 8, 2010 (JP) ..... 2010-131512

(51) Int. Cl.
*H05B 3/34* (2006.01)
*A47C 7/72* (2006.01)

(52) U.S. Cl.
USPC ..... 219/549; 219/202; 219/217; 219/211; 219/212; 219/553; 297/180.12; 29/611

(58) Field of Classification Search
USPC ..... 219/217, 202, 211, 212, 553, 549; 297/180.12; 29/611
See application file for complete search history.

(56) References Cited

U.S. PATENT DOCUMENTS

2009/0218854 A1* 9/2009 Pfahler et al. ..... 297/180.12

FOREIGN PATENT DOCUMENTS

JP 2008-67850 A 3/2008
JP 2009-513201 A 4/2009

* cited by examiner

*Primary Examiner* — Shawntina Fuqua
(74) *Attorney, Agent, or Firm* — Greenblum & Bernstein P.L.C.

(57) ABSTRACT

A heater member for a chair, of which the dimension as measured in the width direction is not constant, includes a fabric of a weft knitting structure having a plurality of conductive threads woven into the fabric as a part of constituent yarn. Each of the conductive threads has substantially the same length.

9 Claims, 12 Drawing Sheets

A > B
a > b

HEATER MEMBER FOR CHAIR AND METHOD FOR PRODUCING THE SAME

INCORPORATION BY REFERENCE

The disclosure of Japanese Patent Application No. 2010-131512 filed on Jun. 8, 2010 including the specification, drawings and abstract is incorporated herein by reference in its entirety.

BACKGROUND OF THE INVENTION

1. Field of the Invention

The invention relates to a heater member for a chair and a method for producing the same. More specifically, the invention relates to a heater member for a chair, wherein a plurality of conductive threads woven into a fabric as a part of constituent yarn have substantially the same length even though the dimension of the heater member as measured in the width direction varies from portion to portion, so that the temperature of the heater member can be uniformly raised not only in the width direction (that is the same direction as the course direction of the fabric), but also in the longitudinal direction (that is the same direction as the wale direction of the fabric), so as to uniformly and sufficiently warm a seat of the chair, or the like. The invention also relates to a method for producing such a heater member for a chair.

2. Description of the Related Art

A seat for a vehicle, in particular, for a passenger automobile, or the like, is known in which a heater member is attached to a rear surface of a skin material of a seat bottom, or the like, so as to warm a passenger from the down side in the wintertime, for example. A seat heater for heating a seat of a chair provided with a seatback is disclosed in Japanese Patent Application Publication No. 2008-67850 (JP-A-2008-67850), in which a heater member used in the seat is woven from and comprised of a plurality of conductive warp threads that generate heat when energized, and a plurality of non-conductive weft threads that are electrically insulated from the conductive warp threads, and the conductive warp threads are arranged more closely in a portion remote from the seatback, than in a seatback-side portion close to the seatback. In the seat heater, the conductive warp threads in the seatback-side portion that bears a larger proportion of the weight of a seated passenger than the other portion of the seat of the chair are less likely or unlikely to be largely bent and disconnected each time the passenger is seated.

As a heater used in a seat, one type of product has been developed which is formed by cutting out a heater member having a predetermined shape, from an original fabric into which conductive threads are woven as yarn constituting the fabric, and attaching the heater member to a rear surface of a skin material of the seat. In this type of product, the heater member having the predetermined shape, which is cut out from the original fabric, is used. In the meantime, a seat of a passenger automobile, or the like, is often shaped such that the width of the seat bottom or seat cushion is reduced from the front side to the back side, and the width of the seat back is reduced from the top to the bottom. In this case, the length of the conductive threads increases from the back side to the front side of the seat bottom, and increases from the top to the bottom of the seat back. In operation, the conductive threads having varying lengths are connected in parallel and are energized; therefore, the temperature of the seat bottom is less likely to increase in its front portion with which the thigh of the passenger contacts, and the temperature of the seat back is less likely to increase in its upper portion with which the shoulder and back of the passenger contact. Thus, it is difficult to sufficiently warm passenger's regions, such as the thigh, shoulder and back, which are desired to be warmed. In JP-A-2008-67850, no study has been made in terms of variations in the temperature rise due to variations in the length of the conductive threads.

SUMMARY OF THE INVENTION

The invention provides a heater member for a chair, wherein a plurality of conductive threads woven into a fabric as a part of constituent yarn have substantially the same length even though the dimension of the heater member as measured in the width direction is not constant, so that the temperature of the heater member can be uniformly raised not only in the width direction (that is the same direction as the course direction of the fabric), but also in the longitudinal direction (that is the same direction as the wale direction of the fabric), so as to sufficiently warm a seat of the chair, or the like.

A first aspect of the invention is concerned with a heater member for a chair, of which a dimension as measured in a width direction is not constant, and which includes a fabric of a weft knitting structure having a plurality of conductive threads woven into the fabric as a part of constituent yarn. In the heater member for the chair, each of the above-indicated plurality of conductive threads has substantially the same length.

A second aspect of the invention is concerned with a method for producing a heater member for a chair, which includes: cutting out a piece of fabric having a generally rectangular shape, from a fabric of a weft knitting structure having a plurality of conductive threads woven into the fabric as a part of constituent yarn, and forming the piece of fabric into a predetermined shape so as to provide the heater member for the chair. In the production method, each of the above-indicated plurality of conductive threads included in the piece of fabric has substantially the same length.

BRIEF DESCRIPTION OF THE DRAWINGS

The foregoing and further objects, features and advantages of the invention will become apparent from the following description of exemplary embodiments with reference to the accompanying drawings, wherein like numerals are used to represent like elements and wherein.

DETAILED DESCRIPTION OF EMBODIMENTS

Figure 1:
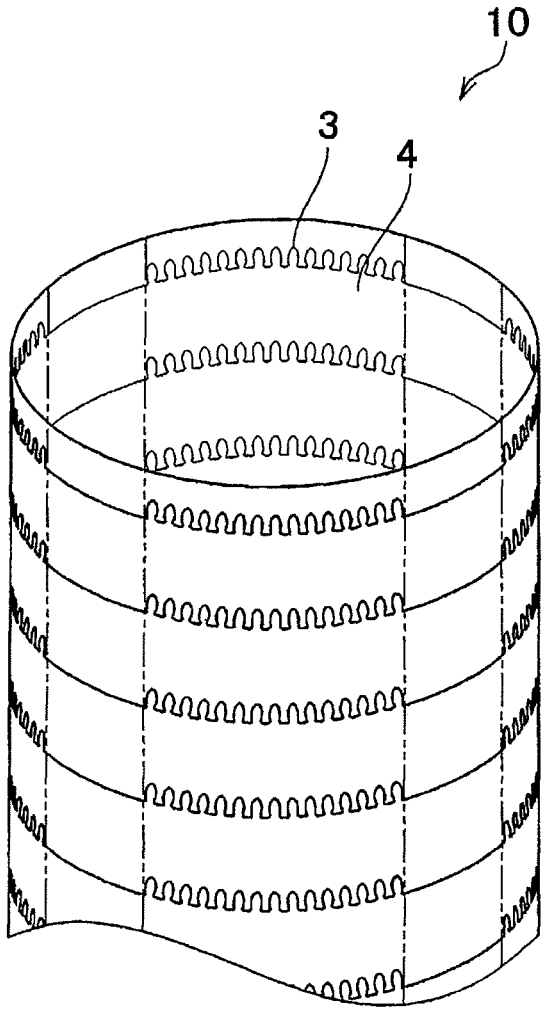
FIG. 1 is a schematic view showing an original fabric in the form of a tubular-knitted fabric into which conductive threads are woven as a part of constituent yarn, as viewed in an oblique direction.

Some embodiments of the invention will be described in detail with reference to FIG. 1 through FIG. 12. The matters indicated herein are merely exemplary ones, and those for describing embodiments of the invention for illustrative purpose, and are stated in order to provide explanation that makes the principle of the invention and its conceptual features understood most effectively without difficulty. In this respect, the following description is not intended to indicate structural details of the invention to an extent greater than that needed for fundamental understanding of the invention, but is provided, along with the drawings, for making how the invention is actually embodied in some forms clear to those skilled in the art.

A heater member for a chair according to a first embodiment of the invention includes a fabric of a weft knitting structure having a plurality of electrically conductive threads woven into the fabric as a part of yarn that constitutes the fabric (which will be called "constituent yarn"). Even though the dimension of the fabric as measured in the width direction varies, each of the conductive threads woven into the fabric as constituent yarn has substantially the same length. While the conductive threads woven into the fabric form loops, the threads having the same length mean that the threads that are in extended, straight form have the same length. Where the conductive threads have the same knitting structure, the number of knitting positions as counted in the course direction is substantially the same, and therefore, the length of each of the conductive threads can be made substantially equal.

The heater member according to this embodiment is characterized in that, even though the dimension of the fabric as measured in the width direction varies, each of the plurality of conductive threads woven into the fabric as constituent yarn has substantially the same length. More specifically, the ratio (L1/L2) of the length of the longest conductive thread (L1) to the shortest conductive thread (L2), out of the plurality of conductive threads, is 1.00-1.06. Namely, the longest conductive thread has the same length as the shortest conductive thread, or is longer by 6% or less than the shortest conductive thread. The ratio (L1/L2) may be 1.00-1.04, in particular, 1.00-1.02. Namely, the longest conductive thread may have the same length as the shortest conductive thread, or may be longer by 4% or less, or 2% or less than the shortest conductive thread.

The above-mentioned "fabric" that provides a base of the heater member according to this embodiment is a fabric having a weft knitting structure. The fabric having the weft knitting structure is obtained by forming loops with threads supplied in the course direction, and sequentially joining the loops in the wale direction. The type of the weft knitting is not particularly limited, but may be circular knitting or flat knitting. Also, the type of weft knitting machine is not particularly limited, but a circular knitting machine or a flat knitting machine may be used as a weft knitting machine. In either case, a single bed knitting machine or a double bed knitting machine may be used. Further, the knitting machine may be a solid color pattern knitting machine or a jacquard pattern knitting machine, either of which may be used. Also, the heater member, which is provided on the back side of a skin material of the chair, may consist of a thin knitted fabric, which can easily expand or stretch. Accordingly, the fabric may be a single jersey formed by using a single bed knitting machine as one type of circular knitting machines.

The above-mentioned "conductive threads" used as a part of constituent yarn are formed of a fiber-like material having an electrical conductivity, to which electric current can be applied, and, in particular, conductive threads having a resistivity (volume resistivity) of $10^{-12}$-$10^{0}$ Ω·cm as measured according to JISK7194 may be used. The conductive threads may be selected from, for example, filaments of carbon fiber, metal wires, plated wire rods, and so forth.

The carbon fiber may be selected from polyacrylonitrile-based carbon fiber (PAN-based carbon fiber), pitch-based carbon fiber, and so forth. Of these, carbon fiber, such as carbonized fiber, graphitized fiber, and graphitic fiber, which is produced at a firing temperature of 1000° C. or higher and has an excellent electrical conductivity, may be used.

The metal wire may be selected from, for example, wire rods made of gold, silver, copper, brass, platinum, iron, steel, such as stainless steel and heat resisting steel, zinc, tin, nickel, aluminum, tungsten, etc. Of these materials, a metal wire made of stainless steel, which has excellent corrosion resistance and strength, may be used. The stainless steel is not particularly limited, but may be selected from, for example, SUS304, SUS316 and SUS 316L, of which SUS304 has broad utility or versatility, while SUS316 and SUS316L contain molybdenum and have excellent corrosion resistance.

While the wire diameter of the metal wire used as the conductive thread is not particularly limited, the wire diameter may be 10-150 μm, in particular, 20-60 μm, in view of the strength and the flexibility. Also, the metal wire may be used in the form of a composite thread consisting of a core thread made of another fiber material, such as polyester fiber, and a metal wire as a clad thread, wherein the metal wire is wound on the core thread in the S and Z twisting directions. In this case, if a metal wire having a small wire diameter is used, a conductive thread having excellent flexibility and sufficient tensile strength owing to the core thread can be obtained.

Also, a metal wire with resin coating applied to its surface may be used as the metal wire. The metal wire of this type, which is protected by the resin layer on its surface, exhibits an excellent antirust property. When connecting members are connected to opposite end portions of a piece of fabric, as described later, the resin layers are peeled off and the metal wires are exposed to the outside so that the connecting members can be electrically connected to the metal wires with reliability. The resin used for coating is not particularly limited, but may be selected from, for example, polyurethane resin, acrylic resin, silicone resin, polyester resin, etc., and polyurethane resin may be used in view of the durability.

Further, the thickness of the resin layer may be set depending on the type of the resin, its durability, the use of the chair on which the heater member is provided, and so forth, and may be set to, for example, 0.05-500 μm, in particular, 1-10 μm. While the method of applying the resin coating is not particularly limited, the metal wire may be immersed in a resin dispersion liquid, or passed through the liquid so that the resin is attached to the metal wire, and thereafter heated, then cooled, so that the resin is fixed to the metal wire. In another method, resin powder or fused resin may be applied to the metal wire, or fused, and heated as needed, then cooled so that the resin is fixed to the metal wire.

As the plated wire rod, a wire rod having a non-conductive or conductive fiber material as a core material, and a plated layer made of a single metal or an alloy may be used wherein the plated layer is formed over the entire length of the core material, to cover the entire surface or a part of the surface of the core material as viewed in the width direction. With the plated layer thus formed on the surface of the core material, a conductive thread can be provided even if the core material is made of a non-conductive fiber material. If the core material is a conductive fiber material, on the other hand, the durability can be improved by forming the plated layer on the core material.

The conductive fiber that can be used as the core material of the plated wire rod may be selected from various types of metal fibers. On the other hand, the non-conductive fiber may be selected from, for example, para-aramid fiber, meta-aramid fiber, polyacrylate fiber, polyphenylene sulfide fiber, polyether ether ketone fiber, polyimide fiber, glass fiber, alumina fibers, silicon carbide fiber, and boron fiber. Further, the metal used in the plating process may be selected from for example, single metals, such as tin, nickel, gold, silver, copper, iron, lead, platinum, zinc, chromium, cobalt and palladium, and alloys, such as nickel-tin, copper-nickel, copper-tin, copper-zinc, and iron-nickel.

The conductive threads may have higher heat resistance than non-conductive threads as other threads used in the fabric. In other words, the temperature at which the conductive threads are fused by heating, or the temperature at which the conductive threads start burning when the threads are not fusible, is higher than that of the non-conductive threads. Namely, the conductive threads may have a higher fusing point than the non-conductive threads, or may be less likely to burn than the non-conductive threads. As an index of the flammability, the limiting oxygen index (LOI) measured according to JISK7201 and JISL1091 (1999) 8.5E-2 method may be used, and conductive threads having the LOI of 26 or greater may be used. Of the above-indicated conductive threads, metal wires generally have a higher fusing point than natural fibers and synthetic fibers used as non-conductive threads, and the LOI of the metal wires is generally 26 or greater. For example, the LOI of stainless-steel fibers is 49.6. Also, the carbon fibers are not fused, and the LOI of the carbon fibers is 60 or greater.

The threads other than the conductive threads, or non-conductive threads, may be selected from threads using, for example, natural fibers derived from plants and animals, recycled fibers, such as rayon, semisynthetic fibers, such as acetate, and synthetic fibers comprising synthetic resins, such as polyamide and polyester. Only one type of such non-conductive threads may be used, or two or more types of the non-conductive threads may be used. The non-conductive threads generally have a resistivity higher than 108 Ω·cm, and provide electrical insulation.

The temperature at which the non-conductive threads are fused by heating, or the temperature at which the non-conductive threads start burning when the threads are not fusible, is lower than that of the conductive threads, and the LOI of the non-conductive threads that burn without fusing may be 26 or less. The LOI of natural fibers is often less than 26; for example, the LOI of cotton is 18-20, and the LOI of wool is 24-25. The fusing point of the synthetic fibers is often lower than that of the conductive threads, and the flammability of the synthetic fibers is often higher than that of the conductive threads. For example, the LOI of polyester fibers is 18-20, and the LOI of polyamide fibers is 20-22.

While the interval or spacing of the conductive threads woven as constituent yarn into the fabric of non-conductive threads is not particularly limited, the interval may be about 2-100 mm, in particular, about 5-50 mm. If the interval is small, the chair can be uniformly warmed, but current per conductive thread (i.e., current applied to each of the conductive threads) is reduced, and the temperature is lowered. If the interval is large, on the other hand, current per conductive thread is increased, and the temperature is raised, or the power consumption can be suppressed or reduced by lowing the voltage. However, variations in the temperature are likely to appear due to the large interval.

The arrangement of the conductive threads in the wale direction of the fabric is not particularly limited, but the conductive threads may be woven into the fabric at substantially equal intervals, or may not be woven at equal intervals. If the conductive threads are woven into the fabric at substantially equal intervals, the entire surfaces of the seat bottom and seat back can be uniformly warmed. If, on the other hand, particular parts, such as the thigh, shoulder and the back, of a seated person are to be sufficiently warmed, the conductively threads may be relatively closely arranged in corresponding portions of the heater member, and may be relatively roughly arranged in the other portions.

Furthermore, only one piece of conductive thread may be woven into between non-conductive threads, or a plurality of pieces, e.g., 2 to 10, in particular, 2 to 5 pieces of conductive threads may be successively woven into between non-conductive threads. In this case, too, the plurality of pieces of conductive threads that are successively woven into the fabric may be arranged at equal intervals in the wale direction of the fabric, or may not be arranged at equal intervals. Thus, the interval of the conductive threads, and the number of pieces of the conductive threads that are successively woven into the fabric, may be suitably adjusted, depending on whether the seat bottom and seat back of the chair are to be uniformly or equally wanted, or the particular portions are more sufficiently warmed.

The dimension of the heater member for the chair according to this embodiment of the invention as measured in the width direction (which is the same direction as the course direction of the fabric) is not constant. Namely, the heater member does not have a substantially rectangular shape, but its dimension as measured in the width direction varies from portion to portion. For example, as in a seat 5 used as a front seat of a passenger automobile, the width of a seat bottom 51 of the seat 5 generally increases from the back toward the front, and the width of a seat back 52 generally decreases from the top toward the bottom. Thus, the dimension of the heater member as measured in the width direction is not constant, but each of the plurality of conductive threads woven into the fabric as constituent yarn has substantially the same length, whereby the seat can be warmed more uniformly in the longitudinal direction of the heater member (which is the same direction as the wale direction of the fabric), and temperature differences or variations in the heater member can be reduced.

A method for producing a heater member for a chair according to a second embodiment of the invention includes a cutting-out step of cutting out a piece of fabric having a substantially rectangular shape, from a fabric of a weft knitting structure having a plurality of conductive threads woven into the fabric as a part of constituent yarn, and a shaping step of giving a predetermined shape to the piece of fabric (i.e., forming the piece of fabric into the predetermined shape), to provide the heater member for the chair, and is characterized in that each of the conductive threads included in the piece of fabric has substantially the same length. In the production method of this embodiment, the above descriptions about the conductive threads and the fabric in connection with the heater element for the chair according to the first embodiment can be equally applied to this embodiment.

In the above-mentioned "cutting-out" step, the "piece of fabric" is cut out from the fabric of the weft knitting structure. While the piece of fabric, which has a generally rectangular shape, may be in the shape of a rectangle or a square, the fabric is often in the shape of a rectangle since it is used as a seat bottom or a seat back of a chair, such as a vehicle seat. The manner of cutting out the piece of fabric from the original fabric is not particularly limited; the piece of fabric may be cut out with a cutter, or may be cut out by irradiating the original fabric with a laser, such as a carbon dioxide gas laser, YAG laser, or an excimer laser.

Figure 2:
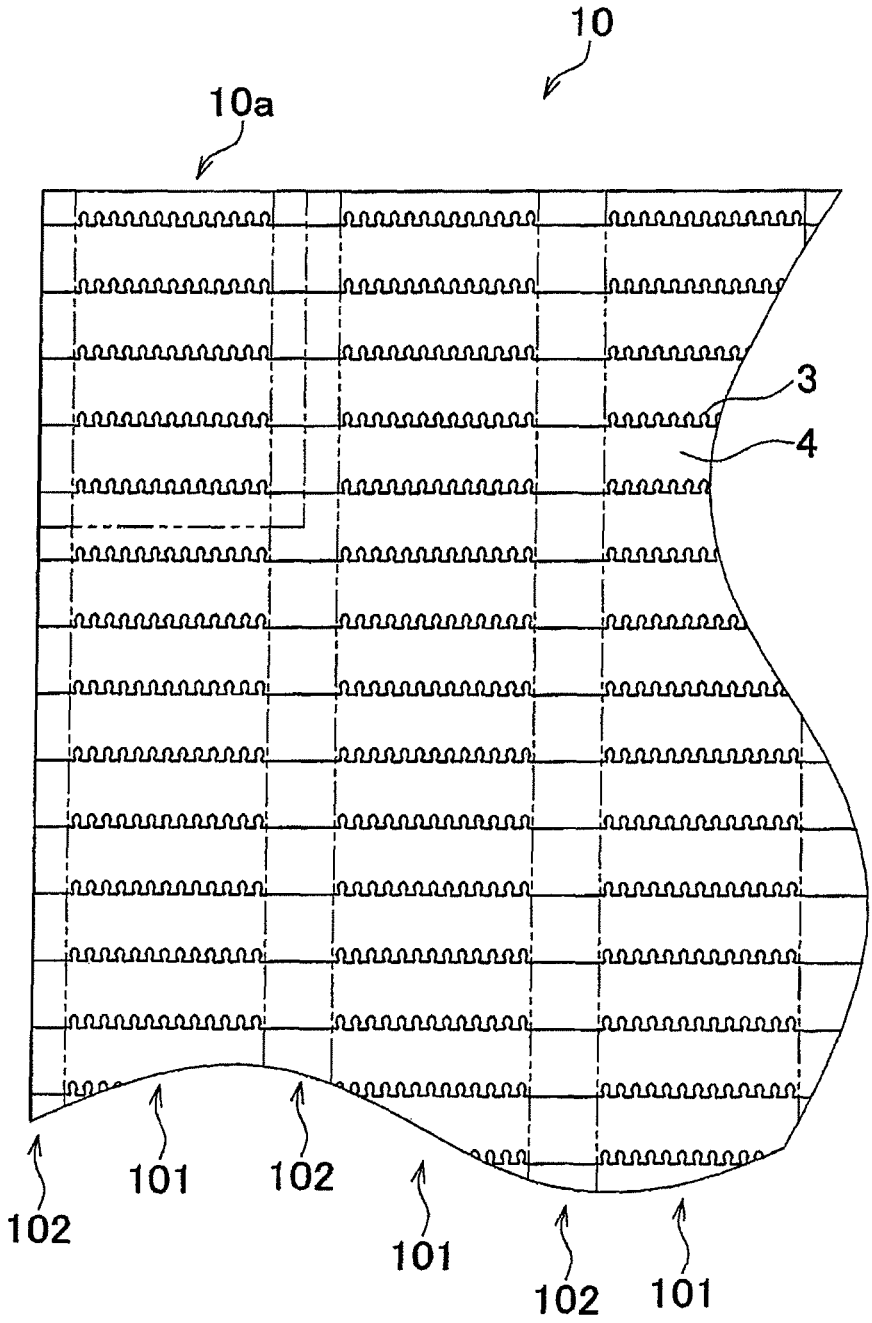
FIG. 2 is an explanatory view showing a condition in which the original fabric of FIG. 1 is unrolled, and a piece of fabric is cut out from a part of the unrolled original fabric.
Figure 3:
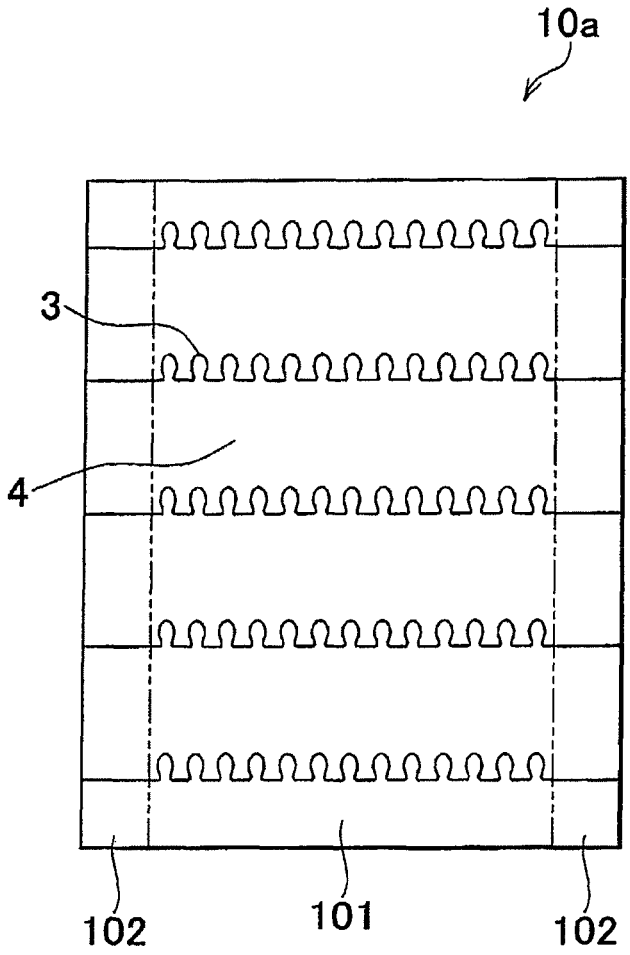
FIG. 3 is a schematic view showing the piece of fabric cut out from the original fabric as shown in FIG. 2, as viewed in the planar direction.

As described above, the fabric is formed by circular knitting or flat knitting. For example, the fabric is formed by circular knitting (see FIG. 1), the resulting original fabric 10 is unrolled (FIG. 2), and a piece of fabric 10*a* is cut out from the unrolled original fabric 10. As shown in FIG. 2, the original fabric 10 has large-width heater portions 101 that provide heaters, and small-width connecting end portions 102 in which opposite end portions of each of the conductive threads are placed for connection with connecting members, such that the heater portions 101 and the connecting end portions 102 are alternately arranged in the width direction. The piece of fabric 10*a* having a rectangular shape with given dimensions as shown in FIG. 3 is cut out by cutting the original fabric 10 to a given length in the wale direction, and cutting the same at substantially middle portions (as viewed in the course direction) of the connecting end portions 102 in the course direction. In the case of flat knitting, the original fabric as shown in FIG. 2 is formed, and the piece of fabric 10*a* as shown in FIG. 3 is cut out from the original fabric.

Figure 4:
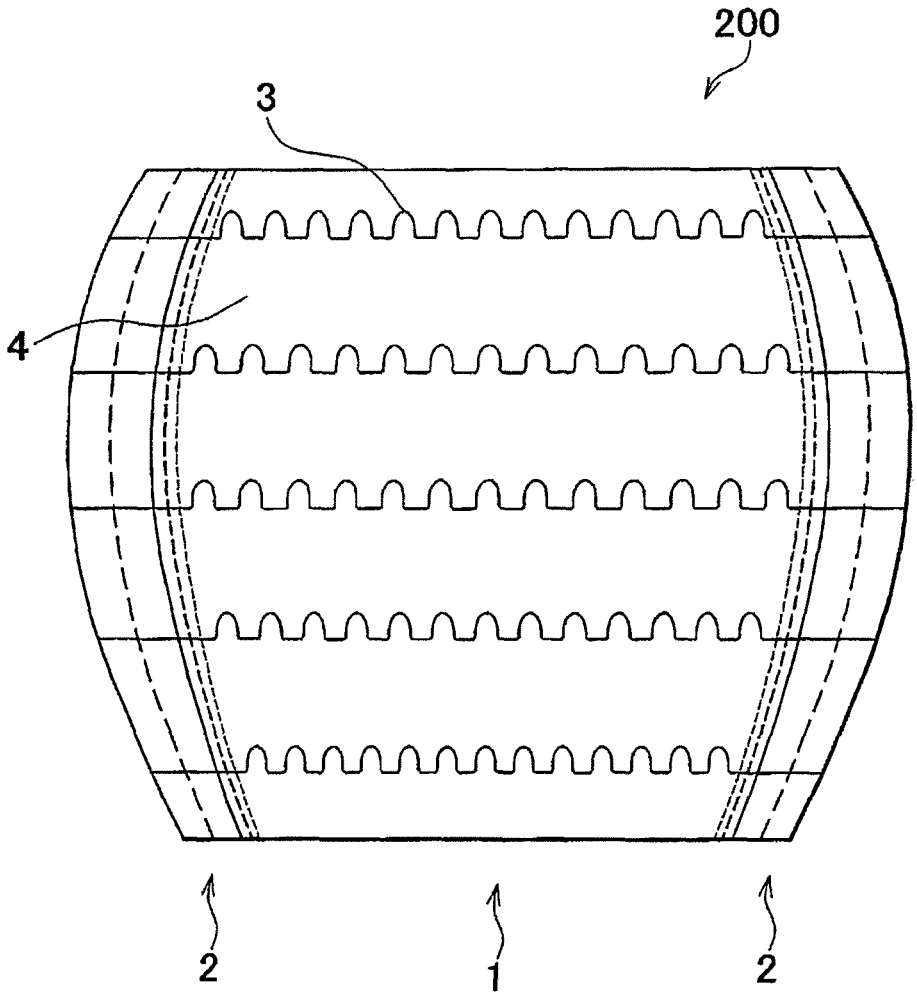
FIG. 4 is a schematic view as seen from the front, showing a heater member for a chair which is formed by expanding the widths of given portions of a generally rectangular piece of fabric to which connecting members are sewed, and forming the piece of fabric into a predetermined shape.

In the above-mentioned "shaping step", the piece of fabric cut out from the original fabric is formed into a predetermined shape. In the shaping step, the piece of fabric cut out from the original fabric in the cutting-out step is formed into a piece, of fabric having substantially the same shape as that of the seat bottom or seat back of the chair. More specifically, the opposite end portions (as viewed in the course direction) of the piece of fabric cut out from the original fabric and having a rectangular shape are fixed in position with needles, clips, or the like, and are extended or pulled in opposite directions of the course direction, into the predetermined shape. Then, the piece of fabric is held in the predetermined shape so that the shape is given to the piece of fabric, i.e., the fabric is in the fixed shape. The shaping method is not limited to any particular method. Where threads comprised of synthetic resin, or the like, are used as non-conductive threads (threads other than the conductive threads) of the fabric, the piece of fabric fixed in the predetermined shape may be heated for a required period of time, at a temperature depending on the type of the synthetic resin, for thermal setting, so that the predetermined shape is given to the piece of fabric. In this manner, a heater member 200 for a chair as shown in FIG. 4 can be obtained.

Figure 5:
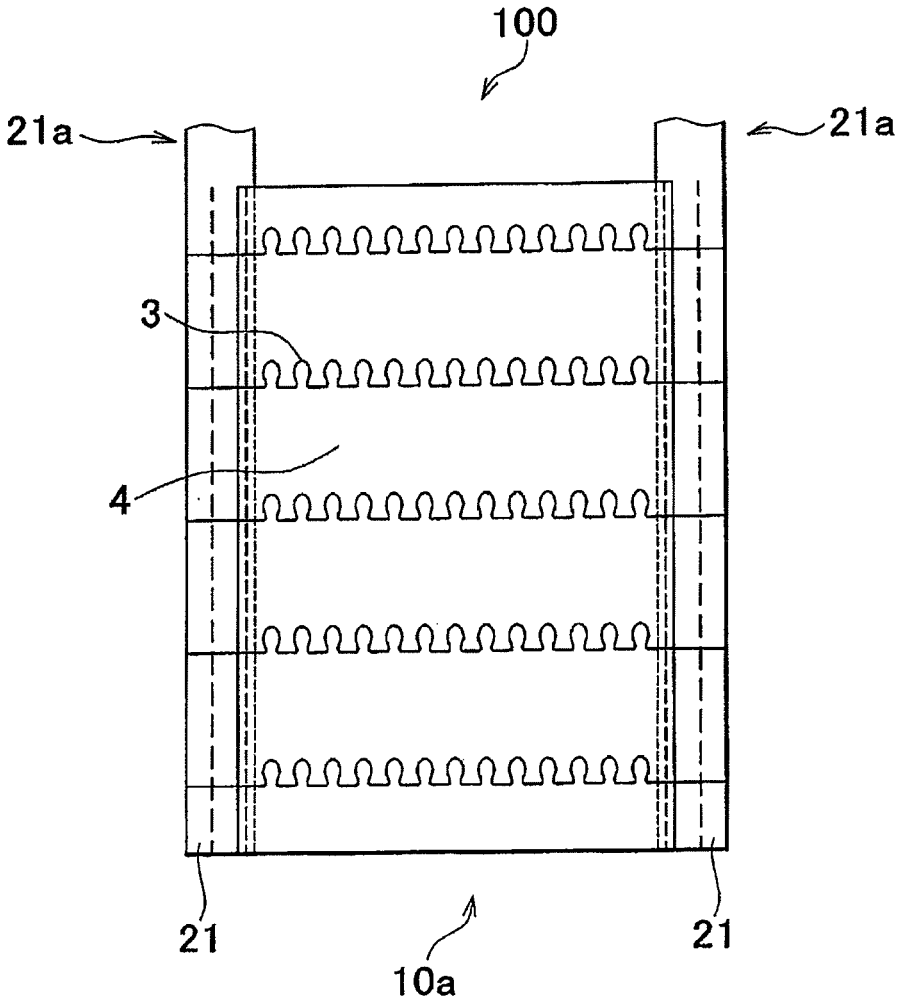
FIG. 5 is an explanatory view showing a condition in which opposite end portions of a rectangular piece of fabric except for conductive threads are removed, and connecting members are sewed to the piece of fabric.

To the opposite end portions (as viewed in the course direction) of the piece of fabric, there are connected connecting members 21 for connecting the conductive threads 3 woven into the fabric with an electronic control unit (which will be abbreviated as "ECU"), as shown in FIG. 5. Namely, the method for producing the heater member according to this embodiment includes a conductive thread connecting step, in addition to the cutting-out step and the shaping step. In the connecting step, the opposite end portions of each of the conductive threads 3 included in the piece of fabric 10*a* (where the conductive thread 3 is provided with an electrically insulating coating, the "opposite end portions" mean "conductive bodies" of the opposite end portions from which the coating is removed) are electrically connected to the connecting members 21 for connecting the opposite end portions with the ECU.

In the above-described conductive thread connecting step, the opposite end portions (as viewed in the course direction) of the conductive threads 3 included in the piece of fabric 10*a* are connected to conductors included in the connecting members 21, and a connecting terminal 21*a* located at one longitudinal end portion of each of the connecting members 21 is connected to the ECU, so that electric power is supplied from a power supply to the conductive threads 3 in response to a signal from the ECU. As a result, the conductive threads 3 generate heat, and the temperature of the piece of fabric 10*a* is raised. FIG. 5, which is useful for explaining the production process, shows a pre-shaping intermediate product 100, which is then shaped to provide the heater member 200 for the chair as shown in FIG. 4.

Figure 6:
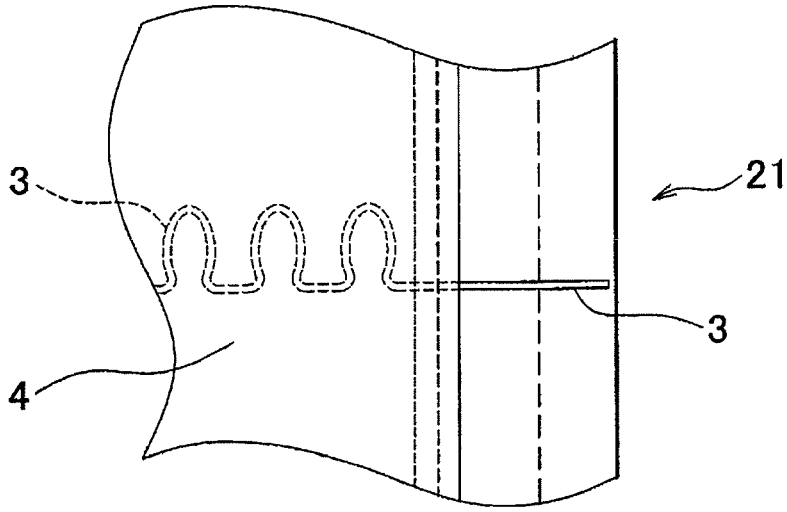
FIG. 6 is a schematic view as seen from the front, showing a condition in which the opposite end portions of the conductive thread are connected to plated layers of the connecting members sewed to the piece of fabric.
Figure 7:
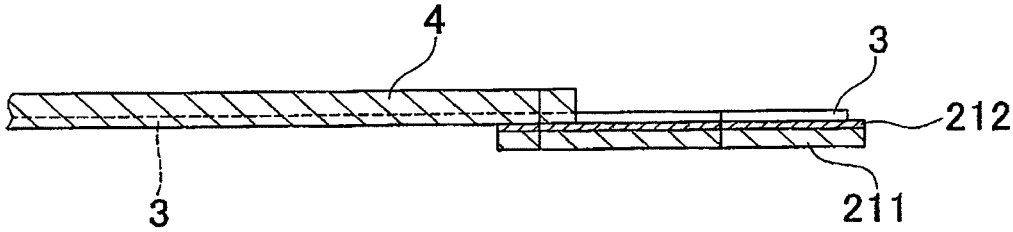
FIG. 7 is a schematic cross-sectional view taken in the lateral direction, showing the condition in which the opposite end portions of the conductive thread are connected to the plated layers of the connecting members sewed to the piece of fabric.

The connecting members may be flexible in view of the easiness of work to attach the connecting members to the shaped piece of fabric, and the likelihood of deforming due to the load when a person is seated in the chair. While the connecting member is not particularly limited, it may be a connecting member 21 as shown in FIG. 6 and FIG. 7, which includes a strip-like substrate 211 formed from a fabric, or the like, and a plated layer 212 formed on at least one surface of the substrate 211 to which an end portion of the conductive thread 3 is connected. With the plated layer 212 held in contact with the end portion of the conductive thread 3, the connecting member 21 can be fixed in position by oversewing, or the like, and then one side end portion of the strip-like substrate 211 is sewed to a corresponding side end portion of the piece of fabric as viewed in the course direction, so that the connecting member 21 is attached to the piece of fabric.

The connecting members may be attached to the generally rectangular piece of fabric that was cut out from the original fabric but has not been formed into the predetermined shape. (see FIG. 5), or may be attached to the piece of fabric that has been formed into the predetermined shape. Since the generally rectangular piece of fabric 10*a* that has not been formed into the predetermined shape has opposite end portions (as viewed in the course direction) that extend straight in the wale direction, the connecting members 21 can be easily attached by sewing, or the like, to the piece of fabric 10*a*. Furthermore, if the connecting members are attached to the piece of fabric by the time when the opposite end portions (as viewed in the course direction) of the piece of fabric are fixed in position with needles, clips, or the like, and are extended or pulled in opposite directions of the course direction, into the predetermined shape, the connecting members can be fixed in position with needles or clips and extended, so that the opposite end portions can be more easily and reliably fixed. Thus, the shaping step may be carried out after the conductive thread connecting step.

Also, when the non-conductive threads woven into the fabric, and the coating material (non-conductive material) where the conductive threads are provided with electrically insulating coating, exist around the opposite end portions of the conductive threads, these non-conductive materials need to be removed before the connecting members are attached to the fabric. These non-conductive materials have lower fusing points than the conductors, or start burning at lower temperatures; therefore, the non-conductive materials can be removed by heating the opposite end portions of the piece of fabric, and fusing or burning the non-conductive materials. The heating means is not particularly limited, but the opposite end portions may be heated by contacting the same with a heating member that is electrically heated, or the like, or by irradiating the same with a laser, such as a carbon dioxide gas laser, YAG laser, or an excimer laser.

If the opposite end portions of the fabric are heated by laser radiation, the intensity and output of the laser can be easily adjusted to the levels required for fusing or burning the non-conductive materials, depending on the types of the non-conductive materials, etc., so that the non-conductive materials can be removed with high efficiency. Further, either of the opposite surfaces of the piece of fabric may be irradiated with the laser, and the fabric may be irradiated with the laser beam with the focal position being displaced or shifted relative to the surface of the piece of fabric, so that a wide range of the fabric can be processed at a time, or the fabric may be irradiated with the laser beam that travels back and forth in the wale direction of the piece of fabric, so that the non-conductive material in the form of a strip can be removed. Also, the laser irradiation may be carried out along with spraying of an inert gas, such as nitrogen gas or helium gas, so that oxidation degradation of the conductors due to overheating can be prevented or at least suppressed.

Figure 8:
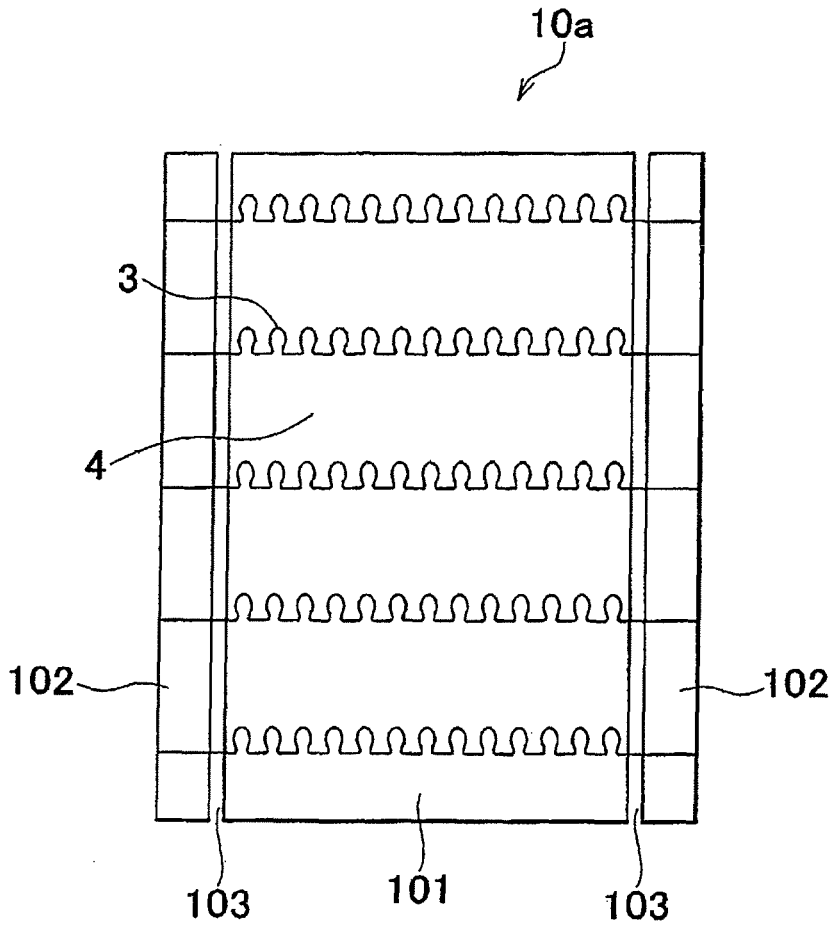
FIG. 8 is an explanatory view showing a condition in which non-conductive materials in the form of strips, or portions of the piece of fabric other than conductive threads, are removed at boundaries between a heater portion of the piece of fabric which functions as a heater, and connecting end portions to which the connecting members are attached.
Figure 9:
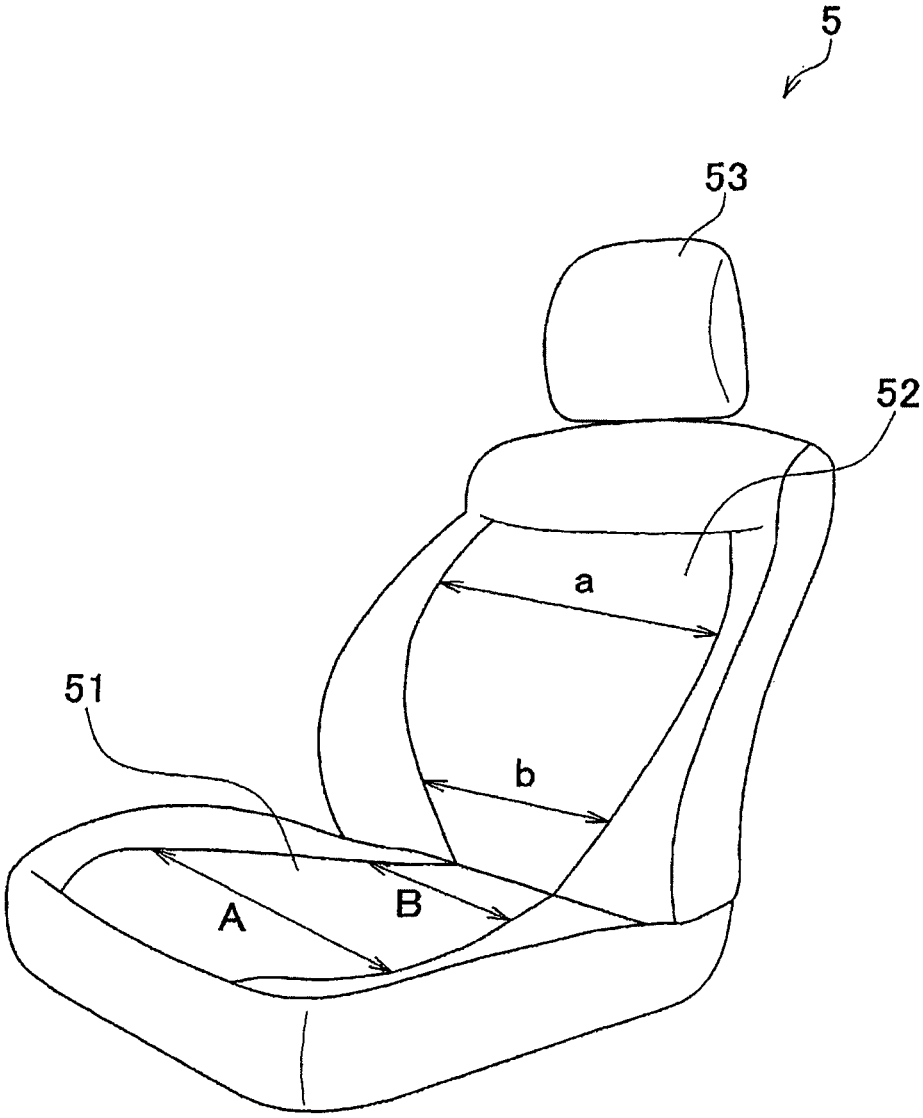
FIG. 9 is a perspective view of a seat of a passenger automobile, which has a skin material having a rear surface to which the heater member for the chair of FIG. 4 is attached.

The non-conductive material of the opposite end portions of the piece of fabric may be entirely removed by heating, but it is not easy to heat the entire surfaces of the opposite end portions of the piece of fabric and fuse or burn the non-conductive material for removal thereof. Therefore, the non-conductive material may be removed in the form of strips extending in the wale direction of the piece of fabric (see non-conductive-material removal portions 103 shown in FIG. 8, and refer to the above description concerning removal of the non-conductive material in the form of strips by laser irradiation), at boundaries between the heater portion 101 of the piece of fabric 10*a* and the connecting end portions 102, as shown in FIG. 8. Then, the connecting end portions 102 at the opposite end portions of the fabric 10*a* are pulled outward and detached from the conductive threads, so that the non-conductive material of the opposite end portions of the piece of fabric 10*a* can be entirely removed. In this manner, the non-conductive material can be removed with improved efficiency.

In the case where the non-conductive removal portions 103 are provided, and then the remaining non-conductive material is removed by pulling the opposite end portions apart from the conductive threads, the opposite end portions of each of the conductive threads are not knitted nor tucked, as shown in FIG. 3, FIG. 6 and FIG. 8. Namely, the opposite end portions of each conductive thread may be in substantially straight form, or at least most of the opposite end portions may be in straight faun with the number of knitted or tucked portions reduced as much as possible. Thus, if the opposite end portions of each of the conductive threads are in substantially straight form, or most of the opposite end portions are in straight form, the non-conductive material can be easily pulled apart from the conductive threads, and removed, and the conductive threads can be easily and surely exposed.

When the heater member is attached to the rear surface of the skin material, and the resulting assembly is used as a seat of a chair, such as a seat cushion of a passenger automobile, for example, the positions of the connecting members as viewed in the width direction of the seat are not particularly limited. However, if the connecting members are located at portions of the seat which contact the hip, thigh, or the like of a seated person, the person would feel uncomfortable about the hardness of the seat. If the assembly of the heater member and the skin material is used as a seat back, and the connecting members are located at portions of the seat back which contact the shoulder, back, or the like, of a seated person, the person would feel uncomfortable about the hardness of the seat. Therefore, the connecting members may be located outwardly of portions where the skin material and other members, such as side materials adjacent to the skin material, are stitched together. With the connecting members thus located, the seated person will not feel uncomfortable, and the durability of the seat can be improved.

Figure 13:
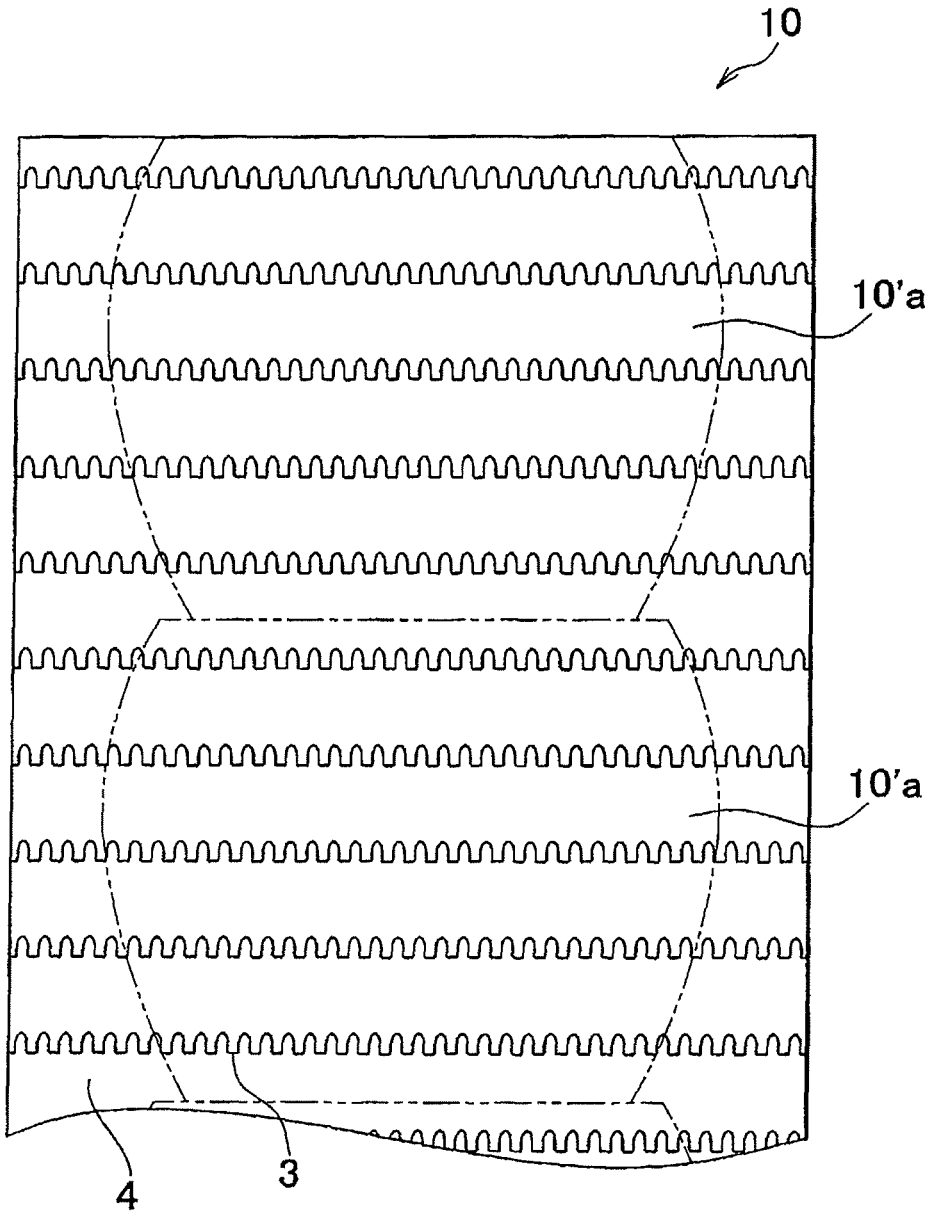
FIG. 13 RELATED ART
FIG. 13 is a schematic view as seen from the front, showing an original fabric from which a piece of fabric having a predetermined shape is cut out, according to the related art.
Figure 14:
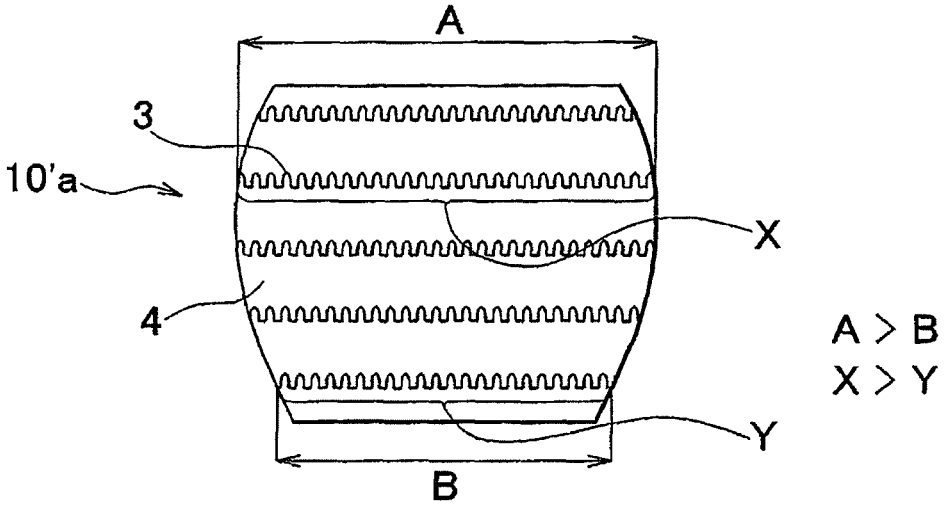
FIG. 14 RELATED ART
FIG. 14 is a schematic view useful for explaining a condition in which the length of the conductive threads woven into the fabric as constituent yarn as measured in the course direction varies in the wale direction, in the piece of fabric having the predetermined shape, according to the related art.

In the case where a piece of fabric 10'*a* (A>B) having a predetermined shape, whose dimension as measured in the width direction is not constant, is cut out from an original fabric 10, as shown in FIG. 13, the length of the conductive thread 3 as measured in the width direction varies (X>Y) in the wale direction, as shown in FIG. 14; therefore, when current is applied in parallel to the respective conductive threads 3, differences in the temperature rise arise in the longitudinal direction (that is the same direction as the wale direction of the fabric) of the heater member. Also, since the piece of fabric having the predetermined shape is cut out from the original fabric, the original fabric has relatively large portions that are located between adjacent pieces of fabric and are discarded without being used, resulting in a low yield.

Figure 10:
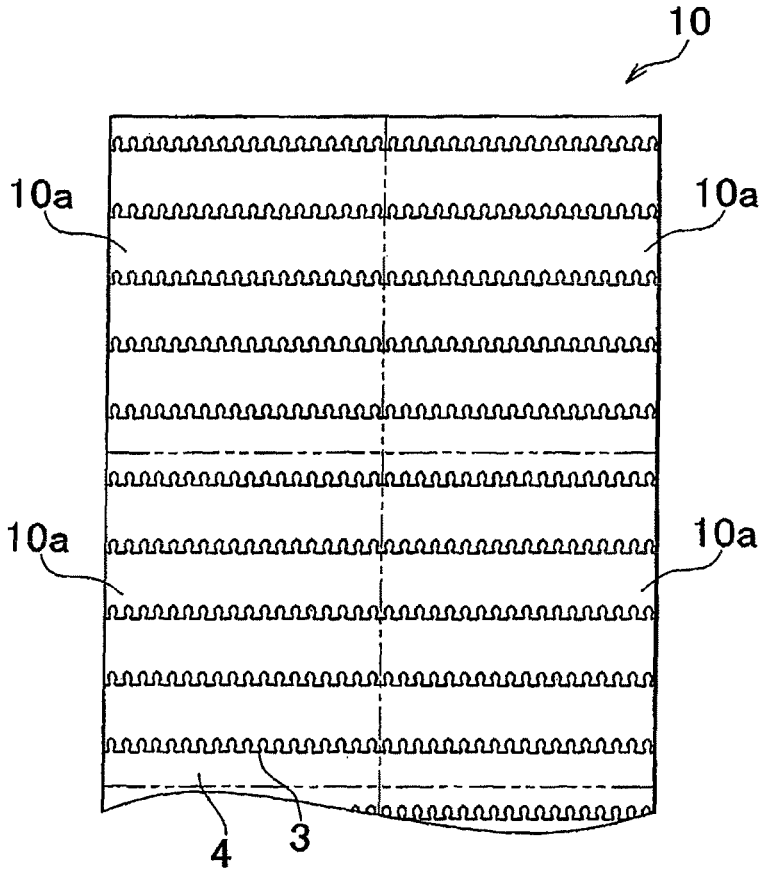
FIG. 10 is a schematic view as seen from the front, showing the original fabric from which a piece of fabric having a generally rectangular shape is cut out.
Figure 11:
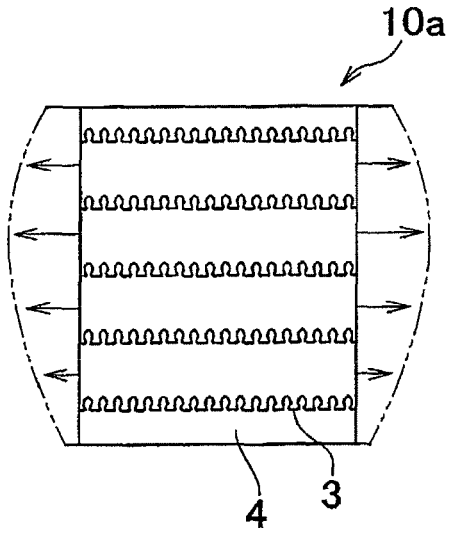
FIG. 11 is a schematic view as viewed from the front, showing a generally rectangular piece of fabric cut out from the original fabric, prior to expansion of the width.
Figure 12:
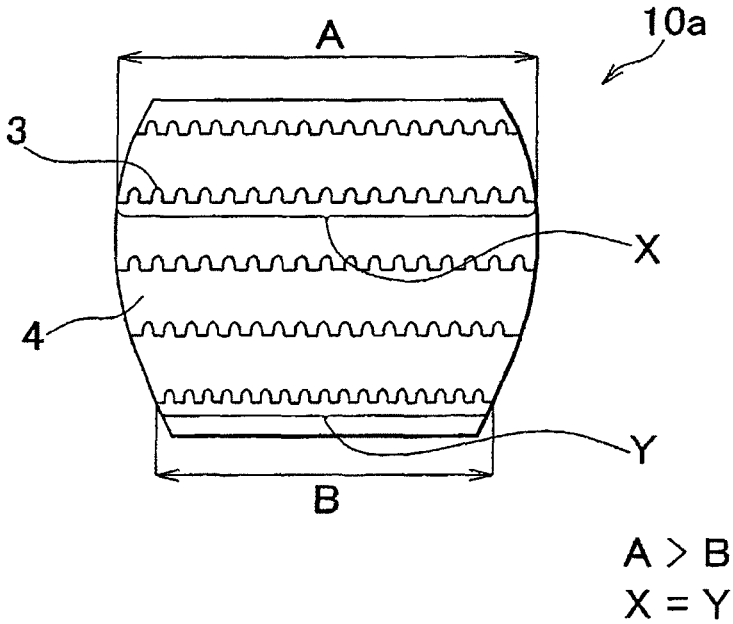
FIG. 12 is a schematic view useful for explaining a condition wherein the width of the generally rectangular piece of fabric is expanded so that the piece of fabric is formed into a predetermined shape, and wherein the length of the conductive threads woven into the fabric as constituent yarn as measured in the course direction is substantially equal in the wale direction.

According to the method for producing the heater member according to this embodiment, a piece of fabric 10*a* having a generally rectangular shape, namely, having a generally constant widthwise dimension, is cut out from the original fabric 10, as shown in FIG. 10, and then the width of the piece of fabric 10*a* is increased (i.e., the piece of fabric 10*a* is extended in opposite directions of the width direction as indicated by arrows in FIG. 11) so that the piece of fabric 10*a* is formed into a predetermined shape, as shown in FIG. 11. In this manner, the piece of fabric 10*a* to which the predetermined shape is given is obtained (A>B), as shown in FIG. 12. In this case, the dimension of the piece of fabric 10*a* as measured in the width direction changes due to the expansion of the width, but the conductive threads 3 have substantially the same length (X=Y). Thus, when current is applied in parallel to the respective conductive threads 3, the temperature of the heater member rises uniformly in the longitudinal direction (that is the same direction as the wale direction of the fabric). Furthermore, since the piece of fabric having a generally rectangular shape is cut out from the original fabric, almost no wasted portions appear between adjacent pieces of the fabric, thus assuring a high yield.

In the following, one example according to the above embodiment of the invention will be specifically described. As a conductive thread of the example, a core-clad fiber was used in which a twisted yarn composed of seven SUS316 fibers each having a diameter of 40 μm, which are twisted in the Z direction at 150 T/m in advance, and a fusion yarn of 122dtex (trade name "ELDER" manufactured by Toray Industries, Inc.) are used as a core material, which is covered with polyethylene terephthalate (PET) filament false-twisted yarn of 330dtex, 72 filaments, which are twisted in the S and Z directions at 1500 T/m, as a clad material. After covering, the conductive thread was thermally set, so that the clad material would not be displaced. The conductive thread thus produced showed an excellent covering characteristic, with which the SUS yarn was not seen when observed from the surface of the covering material.

Thereafter, a fabric having a weft knitting structure was knitted using PET false-twisted yarn and the above-described conductive threads. A double jersey was knitted using a both-side needle selection machine (type "V-LEC4DS" available from Precision Fukuhara Works, Ltd., cylinder/dial diameter: 30 inches, gauge: 18, feeders: 48) as a weft knitting machine. Also, a single jersey was knitted using a weft knitting machine (type "V-SEC-7" available from Precision Fukuhara Works, Ltd., cylinder/dial diameter: 30 inches, gauge: 18, feeders: 24). In knitting of the single jersey, three sets of 496 needles (1488 needles in total), out of 1728 needles, were used for knitting seating portions (see the heater portions 101 of FIG. 2, 3) and four sets of 60 needles (240 needles in total) were used for knitting connecting portions (see the connecting end portions 102 of FIG. 2) between the heater portions and at one end portion thereof. In the connecting portions, the conductive threads were in generally straight form, with the number of loops reduced, so that the PET yarn as a non-conductive material could be easily removed, and the conductive threads could be easily connected to the connecting members.

Then, the resulting tubular-knitted fabric was unrolled, and a piece of fabric having a rectangular shape was cut out from the unrolled original fabric, such that the connecting portions were located at opposite end portions of the seating portion, and unnecessary PET yarn in the opposite end portions as the connecting portions was removed by the use of a laser. Then, the fabric is irradiated again with the laser so that the PET yarn wound as a clad material around the conductive threads was removed, so that the SUS yarn was exposed. Thereafter, connecting belts as the connecting members and the SUS yarn were connected by sewing. Then, the connecting belts were sewed to the opposite end portions of the rectangular piece of fabric, and needles were inserted into the connecting belts sewed to the fabric. In this condition, the needles were individually moved by different distances in the lateral direction in accordance with the shape of the skin material, and the piece of fabric was thermally set in a condition where the fabric was pulled in the course direction, to thus provide a heater member. In the thermal setting, the piece of fabric was dry-heated at 180° C. for one minute, and then cooled to the room temperature (20-30° C.); then, the needles for fixing the fabric in position were removed, to provide the heater member.

Thereafter, the heater member obtained by thermal setting was joined to the rear surface of the skin material made of genuine leather, using powder for thermal adhesion or bonding. In addition, a polyurethane foam seat having a thickness of 5 mm was attached to the rear surface (opposite to the surface to which the skin material was joined) of the heater member. Then, side members were connected by sewing to the outer sides of the connecting portions, to thus provide a seat cover, with which a seat cushion was covered. For comparison, a seat cover having the same construction except that no heater member was attached was fabricated, and a seat cushion was covered with the seat cover. In this case, a seat heater formed by attaching conductive wires in the form of 1.5 mm-diameter nichrome wires covered with resin to a nonwoven surface was placed under a 5 mm-thickness polyurethane foam sheet, on a urethane pad.

The seat using the heater member for chair according to the example fabricated as described above and the seat fabricated for the purpose of comparison had no difference in the quality of tailoring or fitting. However, with regard to the comfort of the passenger who sits in the seat, the passenger felt uncomfortable about the hardness of the conductive wires incorporated in the seat for comparison, whereas the passenger sitting in the seat using the heater member for chair according to the above example did not feel uncomfortable at all, and the seat was excellent in terms of the texture.

The summary of the illustrated embodiments of the invention will be described below.

The first embodiment of the invention is concerned with a heater member for a chair (which may be simply referred to as "heater member") which includes a fabric of a weft knitting structure having a plurality of conductive threads woven into the fabric as a part of constituent yarn, and of which the dimension as measured in the width direction is not constant. In the heater member for the chair, each of the plurality of conductive threads has substantially the same length. With the above arrangement, since each of the conductive threads woven into the fabric as a part of constituent yarn has substantially the same length even though the dimension of the fabric as measured in the width direction varies from portion to portion, the temperature of the heater member is more uniformly raised not only in the width direction (that is the same direction as the course direction of the fabric), but also in the longitudinal direction (that is the same direction as the wale direction of the fabric), and all of the regions, including the thigh, of a seated person which are in contact with the chair can be more evenly and sufficiently warmed.

In the heater member for the chair according to the above embodiment, the ratio of the length of the longest conductive thread to the length of the shortest conductive thread, out of the above-indicated plurality of conductive threads, may be 1.00 to 1.06. With this arrangement, the temperature of the heater member can be raised more uniformly in the longitudinal direction.

In the heater member for the chair according to the above embodiment, the plurality of conductive threads may be woven into the fabric at substantially equal intervals in the wale direction of the fabric. With this arrangement, the temperature of the heater member can be raised more uniformly in the longitudinal direction, and all of the regions, such as the thigh, of a seated person, which are in contact with the chair, can be more sufficiently warmed.

The second embodiment of the invention is concerned with a method for producing a heater member for a chair, including the steps of: cutting out a piece of fabric having a generally rectangular shape, from a fabric of a weft knitting structure having a plurality of conductive threads woven into the fabric as a part of constituent yarn, and forming the piece of fabric into a predetermined shape, to provide the heater member for the chair. In the production method, each of the plurality of conductive threads included in the piece of fabric has substantially the same length. With this arrangement, even though the dimension of the heat member as measured in the width direction varies from portion to portion, the conductive threads woven into the fabric as constituent yarn have substantially the same length, and therefore, the heater member whose temperature can be uniformly raised in the longitudinal direction as well as the width direction can be easily produced.

The production method according to the second embodiment may further include the step of electrically connecting opposite end portions of each of the plurality of conductive threads included in the piece of fabric formed into the predetermined shape, to connecting members provided for connecting the conductive thread with an electronic control unit. With this arrangement, the piece of fabric can be more easily formed into the heater member having the predetermined shape, by a method, such as placing pins on or into the connecting members when shaping the fabric, for example, In the method for producing the heater member for the chair according to the second embodiment, the opposite end portions of each of the plurality of conductive threads may be in substantially straight form. With this arrangement, the non-conductive materials of the opposite end portions of the piece of fabric can be easily removed, and the conductive threads can be easily exposed, so that the conductive threads and the connecting members can be electrically connected with improved reliability.

In the method for producing the heater member for the chair according to the second embodiment, the piece of fabric may be formed into the predetermined shape by thermally setting the piece of fabric having the predetermined shape. With this arrangement, it is possible to easily produce the heater member having the predetermined shape, in which the conductive threads woven into the fabric as constituent yarn have substantially the same length.

In the method for producing the heater member for the chair according to the second embodiment, the ratio of the longest conductive thread to the length of the shortest conductive thread, out of the plurality of conductive threads, may be 1.00 to 1.06.

In the method for producing the heater member for the chair according to the second embodiment, the plurality of conductive threads may be woven into the fabric at substantially equal intervals in the wale direction of the fabric.

The present invention may be applied to heaters for various types of chairs, such as a chair (seat) for a vehicle, office chair, armchair, comfort chair, couch, pipe chair, and a stool, each having at least the seat bottom. In particular, the invention is useful as a heater member that warms a seat, or the like, used outdoors, like a vehicle seat of a passenger automobile, for example.

While some embodiments of the invention have been illustrated above, it is to be understood that the invention is not limited to details of the illustrated embodiments, but may be embodied with various changes, modifications or improvements, which may occur to those skilled in the art, without departing from the scope of the invention.

What is claimed is:

1. A heater member for a chair, of which a dimension as measured in a width direction varies, comprising:

a stretched fabric of a weft knitting structure that is stretched from a first shape having a generally constant width so as to have a predetermined shape that varies in width in a course direction of the fabric and having a plurality of conductive threads woven into the fabric as a part of constituent yarn, wherein each of said plurality of conductive threads, in an extended straight form, has substantially the same length.

2. The heater member according to claim 1, wherein the ratio of the length of the longest conductive thread to the length of the shortest conductive thread, out of said plurality of conductive threads, is 1.00 to 1.06.

3. The heater member according to claim 1, wherein said plurality of conductive threads are woven into the fabric at substantially equal intervals in a wale direction of the fabric.

4. A method for producing a heater member for a chair, comprising:

cutting out a piece of fabric having a generally rectangular shape, from a fabric of a weft knitting structure having a plurality of conductive threads woven into the fabric as a part of constituent yarn; and stretching the piece of fabric into a predetermined shape so as to vary in width in a course direction of the fabric and provide the heater member for the chair, wherein each of said plurality of conductive threads, in an extended straight form, has substantially the same length.

5. The method for producing the heater member for the chair according to claim 4, further comprising electrically connecting opposite end portions of each of said plurality of conductive threads included in the piece of fabric formed into the predetermined shape, with connecting members for connecting the conductive threads with an electronic control unit.

6. The method for producing the heater member for the chair according to claim 5, wherein the opposite end portions of each of said plurality of conductive threads are in substantially straight form.

7. The method for producing the heater member for the chair according to claim 4, wherein the piece of fabric is formed into the predetermined shape by thermally setting the piece of fabric having the predetermined shape.

8. The method for producing the heater member for the chair according to claim 4, wherein the ratio of the length of the longest conductive thread to the length of the shortest conductive thread, out of said plurality of conductive threads, is 1.00 to 1.06.

9. The method for producing the heater member for the chair according to claim 4, wherein said plurality of conductive threads are woven into the fabric at substantially equal intervals in a wale direction of the fabric.

* * * * *